US006828084B2

(12) United States Patent
Haye et al.

(10) Patent No.: US 6,828,084 B2
(45) Date of Patent: Dec. 7, 2004

(54) ODORLESS PHOTOGRAPHIC BLEACHING COMPOSITION AND COLOR PHOTOGRAPHIC PROCESSING

(75) Inventors: Shirleyanne E. Haye, Rochester, NY (US); Janet M. Huston, Webster, NY (US); Eric R. Schmittou, Rochester, NY (US); Therese M. Feller, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/694,373

(22) Filed: Oct. 27, 2003

(65) Prior Publication Data

US 2004/0086810 A1 May 6, 2004

Related U.S. Application Data

(62) Division of application No. 10/259,110, filed on Sep. 27, 2002, now abandoned.

(51) Int. Cl.[7] ..... G03C 7/30; G03C 7/42

(52) U.S. Cl. ..... 430/357; 430/393; 430/401; 430/430

(58) Field of Search ..... 430/357, 393, 430/401, 430

(56) References Cited

U.S. PATENT DOCUMENTS

| | | | | |
|---|---|---|---|---|
| 2,943,935 | A | 7/1960 | Welliver | 430/461 |
| 4,033,771 | A | 7/1977 | Borton et al. | 430/460 |
| 4,717,649 | A | 1/1988 | Hall et al. | 430/460 |
| 4,737,450 | A | 4/1988 | Hall et al. | 430/460 |
| 4,816,384 | A | 3/1989 | Fruge et al. | 430/465 |
| 4,933,266 | A | 6/1990 | Stephen et al. | 430/393 |
| 5,055,382 | A | 10/1991 | Long et al. | 430/400 |
| 5,250,401 | A | 10/1993 | Okada et al. | 430/393 |
| 5,352,568 | A | 10/1994 | Kuse et al. | 430/393 |
| 5,633,124 | A | 5/1997 | Schmittou et al. | 430/372 |
| 5,935,745 | A | 8/1999 | Ohtsu et al. | 430/31 |

FOREIGN PATENT DOCUMENTS

| | | |
|---|---|---|
| EP | 0 334 317 A2 | 9/1989 |
| EP | 0 595 102 A1 | 5/1994 |

OTHER PUBLICATIONS

USSN 10/012,611, filed Oct. 30, 2001, titled "Odorless Photographic Bleach–Fixing Composition and Method of Use" by S.E. Haye et al.

USSN 10/012,673, filed Oct. 30, 2001, titled "Processing Photographic Material" by P.J. Twist.

USSN 10/012,773 filed Oct. 30, 2001, titled "Odorless Photographic Fixing Composition And Method of Use" S.E. Haye et al.

*Primary Examiner*—Hoa Van Le
(74) *Attorney, Agent, or Firm*—J. Lanny Tucker

(57) ABSTRACT

A photographic bleaching composition has reduced odor and acceptable storage stability. It comprises an iron-ligand complex bleaching agent, a rehalogenating agent, and a phthalic acid or salt thereof. This bleaching composition can be used in various photographic processing protocols to provide color images from color photographic silver halide materials, especially photographic color papers. The bleaching step can also be preceded by an acidic stop that also includes a phthalic acid or salt thereof.

15 Claims, No Drawings

ODORLESS PHOTOGRAPHIC BLEACHING COMPOSITION AND COLOR PHOTOGRAPHIC PROCESSING

CROSS-REFERENCE TO RELATED APPLICATION

This is a Divisional of application Ser. No. 10/259,110, filed Sep. 27, 2002 now abandoned.

FIELD OF THE INVENTION

This invention relates in general to photography. More particularly, it relates to a photographic bleaching composition, and to a method of processing photographic color materials using that composition.

BACKGROUND OF THE INVENTION

The basic image-forming process of color silver halide photography comprises the exposure of a silver halide color photographic recording material to actinic radiation (such as light) and the manifestation of a useful image by wet chemical processing of the material. The fundamental steps of this wet processing include color development to reduce silver halide to silver and to produce dye images in exposed areas of the material. During or after bleaching to oxidize metallic silver to silver(I), the silver ion is generally removed by dissolving it in a silver solvent, commonly known as a fixing agent.

The most common bleaching agents for color photographic processing are complexes of ferric [Fe(III)] ion and various organic chelating ligands (such as aminopolycarboxylic acids), of which there are hundreds of possibilities, all with varying photographic bleaching abilities and biodegradability. Common organic chelating ligands used as part of bleaching agents for photographic color film processing include ethylenediaminetetraacetic acid (EDTA), 1,3-propylenediaminetetraacetic acid (PDTA) and nitrilotriacetic acid (NTA). Common color paper bleaching is often carried out using EDTA as a chelating ligand.

Throughout the photographic industry, there is a desire to provide photographic processing solutions that are safe and easy to use, photographically effective, and environmentally acceptable. One desirable property is that the solutions are not objectionable due to unpleasant odors. Despite the considerable useful photographic bleaching solutions and processing methods known in the art, there is a continuing need for a highly effective photographic bleaching composition that has reduced odor.

SUMMARY OF THE INVENTION

This invention provides a photographic bleaching composition that has a pH of from about 2 to about 9 when in aqueous form, and comprises:

at least 0.01 mol/l of a ferric-ligand bleaching agent, at least 0.01 mol/l of a rehalogenating agent, and at least 0.01 mol/l of a phthalic acid or a salt thereof.

In preferred embodiments, the present invention provides an aqueous bleaching composition having a pH of from about 3.5 to about 7 and comprising:

from about 0.01 to about 2 mol/l of a ferric-ligand complex bleaching agent, from about 0.01 to about 1 mol/l of bromide ions, and from about 0.01 to about 1 mol/l of sodium hydrogen phthalate, potassium hydrogen phthalate, or a mixture thereof.

In addition, a method of this invention for providing a color photographic image comprises contacting a color developed color photographic silver halide material with the photographic bleaching composition of this invention that is described above.

In addition, a method for providing a color photographic image comprises:

A) color developing an imagewise exposed color photographic silver halide material using a color developing composition, B) contacting the color photographic silver halide material with an acidic stop solution comprising at least 0.01 mol/l of a phthalic acid or a salt thereof, and C) bleaching the color photographic silver halide material with a photographic bleaching composition having a pH of from about 2 to about 9 when in aqueous form and comprising:

at least 0.01 mol/l of a ferric-ligand bleaching agent, at least 0.01 mol/l of a rehalogenating agent, and at least 0.01 mol/l of a phthalic acid or a salt thereof.

The photographic bleaching composition of this invention has been shown to exhibit acceptable keeping stability and reduced odor without diminishing its photographic processing properties. These advantages are achieved by using a phthalic acid or a salt thereof in the bleaching composition. The bleaching composition can be used in a variety of photographic processing methods, and in some embodiments, it is advantageously used after use of an odorless acidic stop solution that also includes a phthalic acid or salt thereof.

DETAILED DESCRIPTION OF THE INVENTION

Photographic bleaching is carried out in one or more steps using one or more photographic bleaching agents that are Fe(III) complexes of carboxylic acids as a first essential component. Preferred carboxylic acid ligands include aminopolycarboxylic acid or polyaminopolycarboxylic acid chelating ligands. At least one of those steps is carried out using the bleaching composition of this invention.

Useful iron-ligand complexes comprise one or more polycarboxylic acid chelating ligands. Particularly useful chelating ligands include conventional polyaminopolycarboxylic acids including ethylenediaminetetraacetic acid and others described in *Research Disclosure*, publication 38957, pages 592–639 (September 1996), U.S. Pat. No. 5,334,491 (Foster et al.), U.S. Pat. No. 5,582,958 (Buchanan et al.), and U.S. Pat. No. 5,753,423 (Buongiorne et al.). *Research Disclosure* is a publication of Kenneth Mason Publications Ltd., Dudley House, 12 North Street, Emsworth, Hampshire PO10 7DQ England. This reference will be referred to hereinafter as "*Research Disclosure*." There are hundreds of possible chelating ligands that are known in the art, the most common ones being ethylenediaminetetraacetic acid (EDTA), 1,3-propylenediaminetetraacetic acid (PDTA), diethylenetriaminepentaacetic acid (DTPA), cyclohexanediaminetetraacetic acid (CDTA), N-(2-carboxyphenyl) ethylenediamine-N,N',N"-triacetic acid, and hydroxyethylethylenediaminetriacetic acid (HEDTA). PDTA is the most useful chelating ligand in the practice of the present invention. The most preferred ligands include EDTA, EDDS (defined below), and PDTA.

Biodegradable chelating ligands are also useful in order to minimize the impact on the environment from discharged photoprocessing solutions.

One particularly useful biodegradable chelating ligand is ethylenediaminedisuccinic acid (EDDS) as described in U.S. Pat. No. 5,679,501 (Seki et al.) and EP 0 532 001B1 (Kuse et al.). All isomers of EDDS are useful, including the [S,S] isomer, and the isomers can be used singly or in mixtures. The [S,S] isomer is most preferred of the iron-EDDS complexes. Other useful disuccinic acid chelating ligands are described in U.S. Pat. No. 5,691,120 (Wilson et al.).

Aminomonosuccinic acids (or salts thereof) are chelating ligands having at least one nitrogen atom to which a succinic acid (or salt) group is attached. These chelating ligands are also useful in iron complexes. U.S. Pat. No. 5,652,085 (Stickland et al.) also provides more details about such chelating ligands, particularly the polyamino monosuccinic acids. Ethylenediamine monosuccinic acid (EDMS) is preferred in this class of chelating ligands.

Other classes of biodegradable aminopolycarboxylic acid or polyaminopolycarboxylic acid chelating ligands that can be used to form biodegradable iron complexes include iminodiacetic acid and its derivatives (or salts thereof), including alkyliminodiacetic acids that have a substituted or unsubstituted alkyl group having 1 to 6 carbon atoms (such as methyl, ethyl, n-propyl, isopropyl, and 1-butyl) as described in EP 0 532 003A1 (Kuse et al.). Particularly useful alkyliminodiacetic acids are methyliminodiacetic acid (MIDA) and ethyliminodiacetic acid (EIDA), and MIDA is the most preferred.

All chelating ligands useful in this invention can be present in the free acid form or as alkali metal (for example, sodium and potassium) or ammonium salts, or as mixtures thereof.

Still other biodegradable chelating ligands can be represented by the following Structure I:

I

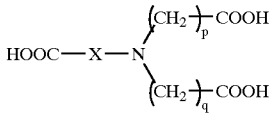

wherein p and q are independently 1, 2 and 3, and preferably each is 1. The linking group X may be any divalent group that does not bind ferric ion and does not cause the resulting ligand to be water-insoluble. Preferably, X is a substituted or unsubstituted alkylene group, substituted or unsubstituted arylene group, substituted or unsubstituted arylenealkylene group, or substituted or unsubstituted alkylenearylene group.

The iron-ligand complexes useful in this invention can be binary complexes (meaning iron is complexed to one or more molecules of a single chelating ligand) or ternary complexes in which iron is complexed to molecules of two distinct chelating ligands similar to iron complexes described for example in U.S. Pat. No. 5,670,305 (Gordon et al.) and U.S. Pat. No. 5,582,958 (noted above). A mixture of multiple binary or ternary iron complexes also can be present in the compositions.

Still other useful biodegradable iron chelating ligands include but are not limited to, alaninediacetic acid, β-alaninediacetic acid (ADA), nitrilotriacetic acid (NTA), glycinesuccinic acid (GSA), 2-pyridylmethyliminodiacetic acid (PMIDA), citric acid, and tartaric acid.

As used herein, the terms "biodegradable" and "biodegradability" refer to at least 80% decomposition in the standard test protocol specified by the Organization for Economic Cooperation and Development (OECD), OECD 301B "Ready Biodegradability: Modified Sturm Test" which is well known in the photographic processing art.

Generally, the one or more ferric-ligand complexes are present in the bleaching compositions in an amount of at least 0.01 mol/l and up to 2 mol/l, and preferably in an amount of from about 0.05 to about 1 mol/l.

Ferric ions in the bleaching agents can be provided from any conventional source including iron salts and iron oxides such as magnetite.

The iron salts used to provide bleaching compounds in the practice of this invention are generally ferric salts that provide a suitable amount of ferric ions for complexation with the chelating ligands defined above. Useful ferric salts include, but are not limited to, ferric ammonium sulfate, ferric sodium sulfate, ferric chloride, ferric nitrate, ferric bromide, ferric sulfate, ferric acetate, ferric oxalate, and ferric gluconate. Ferric nitrate is a preferred ferric salt. These salts can be provided in any suitable form, including various hydrated forms where they exist, and are available from a number of commercial sources.

Ferric ions can also be provided as ferrous ions that are oxidized at an appropriate time prior to or during use in an appropriate way as described in copending and commonly assigned U.S. Ser. No. 10/115,824 (filed Apr. 3, 2002, 2001 by Vincent et al. as a CIP of U.S. Ser. No. 09/723,794 (filed Nov. 28, 2000 by Vincent et al.), and in copending and commonly assigned U.S. Ser. No. 10/002,820 (filed Nov. 15, 2001 by Kuykendall et al.), both incorporated herein by reference.

It is not necessary that the ferric ion and the chelating ligand(s) be present in the bleaching compositions in stoichiometric proportions. It is preferred, however, that the molar ratio of the total chelating ligands to ferric ion be from about 1:1 to about 5:1. In a more preferred embodiment, the ratio is about 1:1 to about 2.5:1 moles of total chelating ligands per mole of ferric ion.

Generally speaking, ferric ions are present in the bleaching precursor compositions in an amount of at least 0.01 mol/l, and preferably in an amount of at least 0.05 mol/l.

One or more rehalogenating agents are also present in the bleaching compositions of the present invention. Chloride, bromide, or iodide ions, or mixtures of halides are common halogenating agents. The preferred halides are chloride and bromide. Such ions are provided in the form of water-soluble salts including ammonium, alkali metal and alkaline earth metal salts. The preferred salts are sodium, potassium and ammonium salts.

It is desired that ammonium ions are the predominant ions in the bleaching compositions. That is, ammonium ions comprise at least 50 mol % of the total cations in the preferred compositions.

The photographic bleaching composition of this invention can be packaged and transported as a dry or liquid formulation, working strength solution, or as a single-part concentrated composition. It can be used as a replenisher as well as the initial tank working solution. Preferably, the photographic bleaching composition is provided in aqueous form and has a pH of from about 2 to about 9. A preferred pH is in the range of from about 3.5 to about 7.

The third essential component of the photographic bleaching composition is a phthalic acid or a salt thereof. By "a phthalic acid", we mean to include substituted phthalic acids. Preferred salts of phthalic acid include hydrogen phthalates such as sodium hydrogen phthalate, potassium hydrogen phthalate, ammonium hydrogen phthalate, lithium hydrogen phthalate, sodium phthalate, and potassium phthalate. Potassium hydrogen phthalate and sodium hydrogen phthalate are preferred. Mixtures of two or more of these compounds can also be used.

The concentrations (general and preferred) of the three essential components of the photographic bleaching composition of this invention are listed in TABLE I below wherein all of the ranges of concentrations are considered to be approximate (that is "about" at the range end points).

TABLE I

| COMPONENT | GENERAL AMOUNT (mol/l) | PREFERRED AMOUNT (mol/l) |
|---|---|---|
| Fe(III)-ligand complex | 0.01 to 2 | 0.05 to 1 |
| Rehalogenating agent | 0.01 to 1 | 0.05 to 0.75 |
| Phthalic acid or salt thereof | 0.01 to 1 | 0.025 to 0.75 |

Optional addenda that can be present in the photographic bleaching composition if desired are materials that do not materially affect its photographic bleaching and fixing functions. Such materials include, but are not limited to, biocides, photographic hardeners, metal ion sequestering agents (such as polycarboxylic acids, polyaminopolycarboxylic acids, and polyphosphonic acids), buffers (such as succinic acid or imidazoles), bleaching accelerators, and other materials readily apparent to one skilled in the photographic art. These and other optional materials can be present in conventional amounts [for example as described in U.S. Pat. No. 5,633,124 (noted above)].

The essential and optional components of the photographic bleaching compositions of this invention can be mixed together in any suitable order as would be known in the art, and stored for a time or used immediately as liquid or solid formulations. They can be formulated in aqueous concentrates such that dilution up to 10 times is required before or during use. Alternatively, they can be formulated as solid compositions (tablets, pellets, powders or granules) and added to a processing tank with appropriate amounts of water for use.

During photographic processing, conventional procedures can be used for replenishment of the various processing solutions, including the photographic bleaching solution. Preferably, the rate of bleaching solution replenishment is not more than 3000 ml/m$^2$, and preferably from about 250 to about 1500 ml/m$^2$ of processed photographic material. The processing equipment can be any suitable processor having one or more processing tanks or vessels, including minilab processors and larger scale processors. The bleaching step can be carried out in one or more tanks or stages arranged in concurrent or countercurrent flow.

The present invention can be used advantageously with any of the known methods of applying photographic bleaching compositions to photographic materials. These methods include, but are not limited to, immersing the material into an aqueous bleaching composition (with or without agitation or circulation), bringing the material into contact with a web or drum surface that is wet with the bleaching composition, laminating the material with a cover sheet or web in such a way that the composition is brought into contact with the material, or applying the bleaching composition to the material by high velocity jet or spray.

The bleaching step can be generally carried out at a temperature of from about 20 to about 65° C. (preferably from about 30 to about 60° C.). The time of processing during this step is generally up to 600 seconds and preferably at least 10 and up to 400 seconds (more preferably from about 10 to about 240 seconds).

The other processing steps desired to provide color images can be similarly rapid or conventional in time and conditions. Preferably the other processing steps, such as color development, fixing, and/or stabilizing (or rinsing), are likewise shorter than conventional times. For example, color development can be carried out for from about 12 to about 360 seconds, a fixing step for from about 12 seconds to about 8 minutes, and stabilizing (or rinsing) for from about 15 to about 240 seconds in various processing protocols. The bleaching step can be carried out more than once in some processing methods. The processing methods can have any of a wide number of arrangements of steps, as described for example in U.S. Pat. No. 5,633,124 (noted above) that is incorporated herein by reference.

In rapid processing methods, the total processing time for color papers can be up to 100 seconds (preferably from about 40 to about 100 seconds).

The present invention can therefore be used to process silver halide materials of various types including color papers (for example using Process RA-4), color motion picture prints (for example using Process ECP), and color positive films (for example using Process E-6), and color negative films (for example using Process C-41). The various processing sequences, conditions and solutions for these processing methods are well known in the art, as well as obvious modifications thereof.

In a preferred embodiment, an acidic stop solution is used between color development and the first bleaching step. The "stop" solution generally is an aqueous solution having a pH below 7. In the present invention, the stop solution can include one or more phthalic acids or salts thereof in an amount of at least 0.01 mol/l and preferably at from about 0.025 to about 1 mol/l. By "a phthalic acid", we mean to include substituted phthalic acids. Preferred salts of phthalic acid include hydrogen phthalates such as sodium hydrogen phthalate, potassium hydrogen phthalate, ammonium hydrogen phthalate, lithium hydrogen phthalate, sodium phthalate, and potassium phthalate. Potassium hydrogen phthalate and sodium hydrogen phthalate are most preferred in the stop solution. The phthalic acid or salt thereof in the stop solution can be the same or different as the phthalic acid or salt thereof in the bleaching composition of the present invention. Preferably, the stop solution and the bleaching composition comprise the same phthalic acid or salt thereof.

Thus, one preferred processing method of the present invention for obtaining color images in photographic color papers includes the following individual processing steps, in order: color development, stop solution, bleaching, fixing, and final rinsing or stabilizing.

The emulsions and other components, and structure of color photographic materials processed using this invention and the various procedures for manufacturing them are well known and described in considerable publications, including, for example, *Research Disclosure*, publication 38957, pages 592–639 (September 1996), and *Research Disclosure*, Volume 370, February 1995, and hundreds of references noted therein. Research Disclosure is a publication of Kenneth Mason Publications Ltd., Dudley House, 12 North Street, Emsworth, Hampshire PO10 7DQ England (also available from Emsworth Design Inc., New York, N.Y. 10011). This reference will be referred to hereinafter as "Research Disclosure". More details about such materials are provided herein below. In particular, the invention can be practiced with photographic color papers containing any of many varied types of silver halide crystal morphology, sensitizers, color couplers, and addenda known in the art, as described in the noted Research Disclosure publication and the many publications noted therein. The color papers can have one or more layers, at least one of which is a silver halide emulsion layer that is sensitive to electromagnetic radiation, disposed on a suitable resin-coated paper support. The supports can be subbed or unsubbed and coated with various antihalation, antistatic, or other non-imaging layers as is known in the art.

Representative photographic materials that can be processed to advantage using the present invention include, but are not limited to, KODAK ROYAL GOLD® Color Films (especially the 1000 speed color film), KODAK GOLD MAX® Color Films, KODAK ADVANTIX® Color Films, KODAK VERICOLOR® III Color Films, KONICA VX400 Color Film, KONICA Super SR400 Color Film, KONICA CENTURIA Color Negative Films, FUJI SUPERIA and NEXIA Color Films, and LUCKY Color Films. Other elements that could be used in the practice of this invention would be readily apparent to one skilled in the art.

More preferably, the invention is used to provide color images in color papers including, but not limited to, the following commercial products: KODAK EKTACOLOR EDGE 5, 7 and 8 Color Papers (Eastman Kodak Company), KODAK ROYAL VII Color Papers (Eastman Kodak Company), KODAK PORTRA III, IIIM Color Papers (Eastman Kodak Company), KODAK SUPRA III and IIIM Color Papers (Eastman Kodak Company), KODAK ULTRA III Color Papers (Eastman Kodak Company), FUJI SUPER Color Papers (Fuji Photo Co., FA5, FA7 and FA9), FUJI CRYSTAL ARCHIVE and Type C Color Papers (Fuji Photo Co.), KONICA COLOR QA Color Papers (Konica, Type QA6E and QA7), and AGFA TYPE II and PRESTIGE Color Papers (AGFA). The compositions and constructions of such commercial color photographic elements would be readily determined by one skilled in the art.

KODAK DURATRANS, KODAK DURACLEAR, KODAK EKTAMAX RAL and KODAK DURAFLEX photographic materials and KODAK Digital Paper Type 2976 can also be processed using the present invention.

Reagents for color development compositions are well known, and described, for example, in Research Disclosure (noted above), sections XVIII and XIX, and the many references described therein. Thus, besides a color developing agent (such as a p-aminophenol or p-phenylenediamine), the color developers can include one or more buffers, antioxidants (or preservatives, such as sulfo-, carboxy, and hydroxy-substituted mono- and dialkylhydroxylamines), antifoggants, fragrances, solubilizing agents, brighteners, halides, sequestering agents, and other conventional addenda. Representative teaching about color developing compositions can also be found in U.S. Pat. No. 4,170,478 (Case et al.), U.S. Pat. No. 4,264,716 (Vincent et al.), U.S. Pat. No. 4,482,626 (Twist et al.), U.S. Pat. No. 4,892,804 (Vincent et al.), U.S. Pat. No. 5,491,050 (Brust et al.), U.S. Pat. No. 5,709,982 (Marrese et al.), U.S. Pat. No. 6,037,111 (Haye et al.), U.S. Pat. No. 6,017,687 (Darmon et al.), U.S. Pat. No. 6,077,651 (Darmon et al.), and U.S. Ser. No. 09/706,474 (filed Nov. 3, 2000 by Arcus et al.), all incorporated herein by reference.

A preferred photographic color developing composition has a pH of from about 9.5 to about 13 and comprises 4-(N-ethyl-N-2-methanesulfonylaminoethyl)-2-methylphenylenediamine sesquisulfate (KODAK Color Developing Agent CD-3), one or more hydroxylamine derivatives as antioxidants, and various addenda commonly included in such compositions.

Fixing can be carried out using conventional fixing compositions that generally include one or more thiosulfate fixing agents in conventional amounts. The thiosulfate can be any of sodium thiosulfate, potassium thiosulfate, ammonium thiosulfate, lithium thiosulfate, calcium thiosulfate, or magnesium thiosulfate, or mixtures thereof such that a desired concentration of thiosulfate ion is provided. Preferably, ammonium thiosulfate or sodium thiosulfate (or a mixture thereof) is used. For rapid fixing, ammonium thiosulfate is preferably used.

Optionally, one or more thiocyanate fixing agents can also be present as a fixing agent especially for more rapid silver removal. If present, it can be provided as sodium thiocyanate, potassium thiocyanate, or ammonium thiocyanate, or mixtures thereof.

A particularly useful photographic fixing composition has a pH of from about 2 to about 9 and comprises ammonium thiosulfate as the fixing agent, sulfite ions, and a buffer such as a phthalic acid or a salt thereof as described above.

Stabilizing or rinsing compositions can include one or more surfactants, and in the case of stabilizing compositions, a dye stabilizing compound such as a formaldehyde precursor, hexamethylenetetraamine or various other aldehydes such as m-hydroxybenzaldehyde. Useful stabilizing or rinsing compositions are described in U.S. Pat. No. 4,859,574 (Gonnel), U.S. Pat. No. 4,923,782 (Schwartz), U.S. Pat. No. 4,927,746 (Schwartz), U.S. Pat. No. 5,278,033 (Hagiwara et al.), U.S. Pat. No. 5,441,852 (Hagiwara et al.), U.S. Pat. No. 5,529,890 (McGuckin et al.), U.S. Pat. No. 5,534,396 (McGuckin et al.), U.S. Pat. No. 5,578,432 (McGuckin et al.), U.S. Pat. No. 5,645,980 (McGuckin et al.), and U.S. Pat. No. 5,716,765 (McGuckin et al.), all incorporated herein by reference.

The photographic bleaching composition of this invention can be provided in any suitable container, and can also be included in a processing kit with one or more other processing compositions in suitable containers.

The processing methods of the present invention can be carried out using any suitable processing equipment or machine that include suitable processing chambers or containers, metering pumps, plumbing, and transport rollers if necessary.

The following examples are provided to illustrate the practice of the present invention and are not meant to be limiting in any way.

EXAMPLE 1

Photographic Bleaching Composition

An odorless photographic bleaching composition of this invention was formulated as shown in TABLE II below.

The Example 1 composition was evaluated for storage stability for over five weeks and compared to a conventional EKTACOLOR$^{(R)}$ RA bleaching solution (CONTROL). Both compositions were stored in an open glass container at room temperature. Any decrease in volume from evaporation was compensated for by periodically adding deionized water. The compositions were analyzed after five weeks for the amounts of remaining bleaching agent (PDTA) and iron. The results are shown in TABLE III below. They indicate that the bleaching compositions of this invention have storage stability compared to the conventional bleaching composition but exhibits no odor.

TABLE II

| COMPONENT | EXAMPLE 1 | CONTROL |
|---|---|---|
| Water | 700 ml | 700 ml |
| Acetic acid | 0 | 5.63 ml |
| Potassium hydrogen phthalate | 20.43 g | 0 |

TABLE II-continued

| COMPONENT | EXAMPLE 1 | CONTROL |
|---|---|---|
| Potassium bromide | 23.93 g | 23.93 g |
| 1,3-Diaminopropane-tetraacetic acid (PDTA) | 15.35 g | 15.35 g |
| 1,3-Diaminopropane-2-ol-tetraacetic acid | 0.5 g | 0.5 g |
| Potassium hydroxide (45% solution) | 21.17 g | 21.17 g |
| Ferric nitrate nonahydrate | 18.33 g | 18.33 g |
| Water to make | 1 liter | 1 liter |
| pH (adjusted with potassium carbonate or sulfuric acid) | 4.75 | 4.75 |

TABLE III

| Time (weeks) | % PDTA Remaining | % PDTA Remaining | % Iron Remaining | % Iron Remaining |
|---|---|---|---|---|
| | Control | Example 1 | Control | Example 1 |
| 0 | 100 | 100 | 100 | 100 |
| 5 | 100 | 100 | 100 | 100 |

The bleaching composition of the present invention produced no precipitates and was very stable to decomposition at pH 4.75.

EXAMPLE 2

Color Paper Processing Method

Samples of KODAK Edge(R) 8 Color Paper were given a step wedge test object exposure at 1/10 sec with HA-50, NP-11 filters, and 0.3 Inconel on a conventional 1B sensitometer. The samples were then processed using the processing protocol and solutions described below.

Color paper Sample A was processed using the conventional EKTACOLOR RA processing method and solutions (Comparison). Color paper Sample B (Invention) was color developed and bleached using the bleaching composition described in Example 1 above. After processing, all samples were air-dried and the residual silver ($g/m^2$) of the samples was determined by X-ray fluorescence as tabulated in TABLE IV below.

Processing Protocol

| | | |
|---|---|---|
| Color development (EKTACOLOR(R) RA) | 45 seconds | 35° C. |
| Stop bath (see below) | 30 seconds | 29–35° C. |
| Wash | 30 seconds | 29–35° C. |
| Bleaching | 90 seconds | 29–35° C. |
| Wash | 45 seconds | 29–35° C. |
| Fixing (see below) | 45 seconds | 29–35° C. |
| Rinsing (water) | 90 seconds | 29–35° C. |

Stop Bath A

| | |
|---|---|
| Water | 900 ml |
| Glacial acetic acid | 7 ml |

Water to make 1 liter, pH adjusted to 4.7 with potassium hydroxide or potassium hydrogen phthalate.

Fixing Solution:

| | |
|---|---|
| Water | 600 ml |
| Potassium sulfite | 12.0 g |
| Ethylenediaminetetraacetic acid, sodium salt | 0.99 g |
| Sodium thiosulfate pentahydrate | 42.72 g |

Water to make 1 liter, pH adjusted to 6.5 with acetic acid.

TABLE IV

| Step Number | Comparison A ($g/m^2$) | Invention Example 2 ($g/m^2$) |
|---|---|---|
| 1 | 0.01 | 0.00 |
| 3 | 0.01 | 0.00 |
| 5 | 0.02 | 0.00 |
| 11 | 0.01 | 0.00 |
| 17 | 0.00 | 0.00 |
| 19 | 0.00 | 0.00 |
| 21 | 0.00 | 0.001 |

Bleaching was considered complete when the residual silver level was less than 0.05 $g/m^2$. The data in Table IV show that the phthalate-containing bleaching composition of the present invention was useful to remove silver from the color paper samples to provide the desired color images within 90 seconds. No odor was detected with the Example 2 composition whereas the Comparison A exhibited some objectionable odor.

EXAMPLE 3

Use of Phthalate Bleaching Composition and Stop Solution: Preferred Processing Method Samples of KODAK Edge(R) 8 Color Paper were given a step wedge test object exposure and processed as described in Example 2. Paper Sample A was processed like Comparison A noted above using Stop Bath A. Paper Sample B was processed as Comparison B using acidic Stop Bath B shown below containing potassium hydrogen phthalate as the buffer. Paper Sample C (Invention) was processed as described in Example 2 above, and Paper Sample D (Invention) was processed using the bleaching composition of Example 2 and acidic Stop Bath B shown below containing potassium hydrogen phthalate. The processed color paper samples were then washed for 120 seconds with water and dried. The residual silver ($g/m^2$) of the color paper samples was determined by X-ray fluorescence and tabulated as shown in TABLE V below.

Stop Bath B:

| | |
|---|---|
| Water | 900 ml |
| Potassium hydrogen phthalate | 25 g |

Water to make 1 liter, pH adjusted to 4.7 with potassium hydroxide or potassium hydrogen phthalate.

TABLE V

| Step Number | Sample A (Comparison) | Sample B (Comparison) | Sample C (Invention) | Sample D (Invention) |
|---|---|---|---|---|
| 1 | 0.00 | 0.00 | 0.01 | 0.00 |
| 3 | 0.00 | 0.00 | 0.00 | 0.01 |
| 5 | 0.00 | 0.00 | 0.00 | 0.00 |
| 11 | 0.00 | 0.00 | 0.00 | 0.00 |
| 17 | 0.00 | 0.00 | 0.00 | 0.00 |
| 19 | 0.00 | 0.00 | 0.00 | 0.00 |
| 21 | 0.01 | 0.00 | 0.00 | 0.00 |

Bleaching was considered complete when the residual silver level was less than 0.05 g/m$^2$. The data in TABLE V show that use of the bleaching compositions of the present invention, with and without, an acidic stop solution containing a phthalate salt, were effective in removing the silver from the color paper samples to provide the desired color images. No odor was observed from the bleaching composition of the present invention or Stop Bath B.

EXAMPLES 4 & 5

Concentration Series in Bleaching Compositions

Bleaching compositions similar to Example 1 were prepared using potassium hydrogen phthalate at 0.05 mol/l and 0.15 mol/l, respectively. The compositions were stored for four weeks and then used to process imagewise exposed and color developed color paper samples using the processing protocol of Example 2. Desired color images were obtained.

EXAMPLE 6

Bleaching Composition Containing Ferric-EDDS

A bleaching composition of the present was prepared with the following components:

| | |
|---|---|
| Water | 700 ml |
| Potassium Hydrogen Phthalate | 20.43 g |
| Potassium bromide | 23.93 g |
| Ethylenediaminedisuccinic acid | 14.6 g |
| 1,3-Diamino-2-propane-2-oltetraacetic acid | 0.5 |
| Potassium hydroxide (45%) | 21.17 ml |
| Ferric nitrate (42.2%) | 26.0 g |
| Water to make 1 liter. | |

The composition pH was adjusted to 4.75 with ammonium hydroxide or sulfuric acid.

EXAMPLE 7

Color Paper Processing Method

Samples of KODAK Edge® 8 Color Paper were given a step wedge test object exposure at 1/10 sec with HA-50, NP-11 filters, and 0.3 Inconel on a conventional 1B sensitometer. The samples were then processed using the processing protocol described in Example 1 using and bleaching composition of Example 6. The desired color images were obtained in the color paper samples.

EXAMPLE 8

Bleaching Composition Containing Ferric EDTA

A bleaching composition of this invention was prepared using the following components:

| | | |
|---|---|---|
| Water | | 700 ml |
| Potassium Hydrogen Phthalate | | 20.43 g |
| Potassium bromide | | 23.93 g |
| EDTA (Free Acid) | | 14.6 g |
| AC#3 | 0.5 | 0.5 |
| Potassium hydroxide (45%) | | 21.17 ml |
| Ferric nitrate (42.2%) | | 26.0 g |
| Water to make 1 liter. | | |

The pH was adjusted to 4.75 with ammonium hydroxide or sulfuric acid.

EXAMPLE 9

Color Paper Processing Method

Samples of KODAK Edge® 8 Color Paper were given a step wedge test object exposure at 1/10 sec with HA-50, NP-11 filters, and 0.3 Inconel on a conventional 1B sensitometer. The samples were then processed using the processing protocol described in Example 1 using the bleaching composition of Example 8. The desired color images were obtained in the color paper samples.

The invention has been described in detail with particular reference to certain preferred embodiments thereof, but it will be understood that variations and modifications can be effected within the spirit and scope of the invention.

We claim:

1. A method for providing a color photographic image comprising contacting a color developed color photographic silver halide material with an acidic stop solution comprising at least 0.01 mol/l of a phthalic acid or a salt thereof, followed by contacting with a photographic bleaching composition that has a pH of from about 2 to about 9 when in aqueous form and comprises:

at least 0.01 mol/l of a ferric-ligand bleaching agent, at least 0.01 mol/l of a rehabogenating agent, and at least 0.01 mol/l of a phthalic acid or a salt thereof.

2. The method of claim 1 further comprising fixing said color developed color photographic silver halide material.

3. The method of claim 1 wherein said color photographic silver halide material is a color photographic paper.

4. A method for providing a color photographic image comprising:

A) color developing an imagewise exposed color photographic silver halide material using a color developing composition, B) contacting said color photographic silver halide material with an acidic stop solution comprising at least 0.01 mol/l of a phthalic acid or a salt thereof, C) bleaching said color photographic silver halide material with a photographic bleaching composition having a pH of from about 2 to about 9 when in aqueous form and comprising:

at least 0.01 mol/l of a ferric-ligand bleaching agent, at least 0.01 mol/l of a rehalogenating agent, and at least 0.01 mol/l of a phthalic acid or a salt thereof.

5. The method of claim 4 further comprising fixing said bleached color photographic silver halide material.

6. The method of claim 4 wherein said color photographic silver halide material is a color photographic paper.

7. The method of claim 4 wherein said ferric-ligand complex is an iron complex of ethylenediaminetetraacetic acid, ethylenediaminedisuccinic acid or 1,3-propylenediaminetetraacetic acid.

8. The method of claim 4 wherein said bleaching composition comprises phthalic acid, sodium hydrogen phthalate, potassium hydrogen phthalate, ammonium hydrogen phthalate, lithium hydrogen pthalate, sodium phthalate, and potassium phthalate, or mixtures of two or more of these compounds.

9. The method of claim 4 wherein said acidic top solution comprises phthalic acid, sodium hydrogen phthalate, potassium hydrogen phthalate, ammonium hydrogen phthalate, lithium hydrogen phthalate, sodium phthalate, and potassium phthalate, or mixtures of two or more of these compounds.

10. The method of claim 4 wherein said acidic stop solution and said bleaching composition comprise the same phthalic acid or a salt thereof.

11. The method of claim 10 wherein said acidic stop solution and said bleaching composition both comprise hydrogen phthalate or potassium hydrogen phthalate.

12. The method of claim 4 wherein said ferric-ligand bleaching agent is present in said bleaching composition in an amount of from about 0.01 to about 2 mol/l.

13. The method of claim 4 wherein said phthalic acid or salt thereof is present in said bleaching composition in an amount of from about 0.01 to about 1 mol/l.

14. The method of claim 4 wherein said phthalic acid or salt thereof is present in said acidic stop solution in an amount of from about 0.025 to about 1 mol/l.

15. The method of claim 4 wherein said bleaching composition further comprises succinic acid or an imidazole.

* * * * *